US006347275B1

(12) United States Patent
Nakano

(10) Patent No.: US 6,347,275 B1
(45) Date of Patent: Feb. 12, 2002

(54) METHOD AND APPARATUS FOR ATTENUATING TORSIONAL VIBRATION IN DRIVE TRAIN IN VEHICLE

(75) Inventor: Futoshi Nakano, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/579,980

(22) Filed: May 26, 2000

(30) Foreign Application Priority Data

May 31, 1999 (JP) ..... 11-152502
Jun. 1, 1999 (JP) ..... 11-154023

(51) Int. Cl.[7] ..... F02D 41/14; F02D 35/00

(52) U.S. Cl. ..... 701/104; 701/110; 701/111; 123/436

(58) Field of Search ..... 701/103, 104, 701/105, 110, 111, 115; 123/436

(56) References Cited

U.S. PATENT DOCUMENTS 6,065,449 A * 5/2000 Fukuma ..... 123/436

FOREIGN PATENT DOCUMENTS

EP 913565 A2 * 5/1999 ..... 701/110
JP 60-26142 2/1985
JP 62-126247 A * 6/1987 ..... 701/111
JP 7-324644 12/1995

* cited by examiner

*Primary Examiner*—Willis R. Wolfe
(74) *Attorney, Agent, or Firm*—McCormick, Paulding & Huber LLP

(57) ABSTRACT

Detected first is fluctuation of engine revolution speed that varies with torsional vibration occurring in a drive train when the vehicle is acceleratedldecelerated. A basic amount of fuel injection (Qbase) is determined from an accelerator opening (APS) and engine revolution speed (RPM). An intermediate value (Qbad), which is an amount of fuel needed at the time of drive power being first transmitted to drive wheels from an engine, is determined from water temperature (Tw) and engine revolution speed (RPM). A difference (Qabs) is calculated by subtracting the intermediate value (Qbad) from the basic value (Qbase). A correction value (Qacl2) to counterbalance the fluctuation of the engine revolution speed (RPM) is then determined based on the difference (Qabs), engine revolution speed (RPM), engine revolution speed change (ΔRPM) and/or its differential value (DΔRPM). A target amount of fuel injection (Qfnl) is sequentially increased/decreased in accordance with the correction value (Qacl2), thereby attenuating the torsional vibration.

14 Claims, 8 Drawing Sheets

METHOD AND APPARATUS FOR ATTENUATING TORSIONAL VIBRATION IN DRIVE TRAIN IN VEHICLE

BACKGROUND OF THE INVENTION

1. Field of the Invention

The present invention relates to a method and apparatus for attenuating torsional vibration in a drive train of a vehicle, and more particular to such method and apparatus that can attenuate torsional vibration caused upon rapid acceleration and deceleration of the vehicle.

2. Description of the Related Art

When a vehicle is accelerated or decelerated quickly, an output of an engine steeply fluctuates and causes torsional vibration in a drive train between the engine and drive wheels. Such torsional vibration results in back and forth oscillation of the vehicle so that passengers in the vehicle feel uncomfortable. To suppress the torsional vibration, an engine revolution speed that changes with the torsional vibration of the drive train is detected and its change rate is calculated. Using the resulting value, an amount of fuel to be injected into the engine is sequentially modified (increased or decreased) to counterbalance the engine speed fluctuation. This technique is known in the art and disclosed, for instance, in Japanese Patent Application Laid-Open Publication Nos. 60-26242 and 7-324644.

The above mentioned conventional method will be described in detail in reference to FIGS. 8A to 8E of the accompanying drawings.

When an accelerator opening APS (accel position sensor detection) is changed to "open" from "closed" (or to a certain value from zero) (FIG. 8A), an engine output steeply increases so that torsional vibration occurs in a drive train operatively coupling an engine with drive wheels. This torsional vibration causes an engine revolution speed RPM to fluctuate (FIG. 8B). A sensor detects the engine revolution speed RPM, and a calculator computes its change rate ΔRPM (ΔRPM=RPM−RPM(−1)) (FIG. 8C) RPM represents the current engine revolution speed, and RPM(−1) represents the engine revolutions speed obtained at previous detection. If ΔRPM is positive (+), an amount of fuel injection for correction Qacl2 (FIG. 8D) takes a negative value in order to suppress ΔRPM. On the other hand, if ΔRPM is a negative value, Qacl2 takes a positive value to reduce ΔRPM. Such correction value Qacl2 is added to a basic amount of fuel injection Qbase, which is determined by the accelerator opening APS and the engine revolution speed RPM (FIG. 8E). The resulting value Qfnl is the corrected amount of fuel injection (target amount of fuel injection).

The correction value Qacl2 is continuously increased and decreased in accordance with the change of ΔRPM to counterbalance ΔRPM and Qfnl is also increased and decreased in the same manner. Further, the basic value Qbase of the final value Qfnl is determined by the accelerator opening and engine speed. Therefore, the fuel is injected in accordance with the accelerator opening APS and it is ensured to provide an engine output in accordance with the accelerator opening. At the same time, a torque sufficient to offset the torsional vibration in the drive train is generated. Accordingly, the torsional vibration is positively attenuated.

Incidentally, the inventor found that the magnitude of torsional vibration in the drive train caused upon change of the accelerator opening APS from "closed" to "open" in FIG. 8A is not determined by the difference between the current target value Qfnl (Qbase) at the time of accelerator opened and the previous target value Qfnl(−1) at the time of accelerator closed, but by the difference Qabs between the current final value Qfnl (Qbase) and the value Qbad at the time of minimum torque being required by the drive wheels (i.e., at the time of a drive force being first transmitted to the drive wheels from the engine). The inventor also found that the difference Qx between Qbad and Qfnl(−1) does not contribute to occurrence of the torsional vibration in the drive train at all.

Therefore, if the correction value Qacl2 described in the preceding paragraphs is determined by the difference Qabs between Qfnl (Qbase) and Qbad, then it is possible to further efficiently attenuate the torsional vibration in the drive train. The value Qbad required to find out the difference Qabs varies with the engine speed RPM and temperature Tw of water flowing in the engine. Thus, if Qbad is obtained from RPM and Tw, Qabs is obtained from Qbad and Qfnl (Qbase), and Qacl2 is determined from Qabs, then it is feasible to efficiently damp the torsional vibration concerned.

In the conventional technique for attenuating the torsional vibration, however, the correction value Qacl2 is never obtained from the difference Qabs. Therefore, there is room for improvement in this regard.

Further, if the above described way of controlling the amount of fuel injection is executed, as illustrated in FIGS. 8A to 8E, it is generally believed that the wave or oscillation of the engine revolution speed change ΔRPM and the wave of the correction value Qacl2 have reversed shapes of the same period (FIGS. 8C and 8D). However, if it is observed microscopically, the correction value Qacl2 is determined after the change occurs in the engine revolution speed RPM. In actuality, therefore, the wave of the correction value Qacl2 fluctuates at a slightly delayed phase λ from the ΔRPM wave. As a result, if the correction value Qacl2 is determined solely from ΔRPM as in the above described control, the correction made becomes "run after" correction having a time delay corresponding to the phase difference λ. Consequently, appropriate correction cannot be expected. This results in longer time to be required in torsional vibration attenuation.

On the other hand, the change in the engine revolution speed RPM is caused by increase and decrease of the amount of fuel injection. Specifically, the difference between the amount of fuel injection before acceleration (or deceleration) and the current amount of fuel injection after acceleration/deceleration becomes the cause of fluctuation of the engine revolution speed RPM, i.e., torsional vibration in the drive train. Thus, the difference Qdelta between the last amount of fuel injection Qaclini prior to quick acceleration (or deceleration) of the vehicle and the current basic amount of fuel injection Qbase should be calculated, and then the corrected amount of fuel injection should be determined from this difference Qdelta. By dosing so, the torsional vibration can be promptly damped as compared with the technique of determining the correction value Qacl2 solely from the engine revolution speed change ΔRPM.

However, the conventional technique of damping the torsional vibration never determines the corrected value from the difference Qdelta Thus, there is also room for improvement in this regard.

SUMMARY OF THE INVENTION

An object of the present invention is to overcome the above described problems and make improvements in the above mentioned regards.

According to one aspect of the present invention, there is provided a method of attenuating torsional vibration in a drive train of a vehicle, including the step of detecting engine revolution speed fluctuation that varies with torsional vibration caused in the drive train when the vehicle is quickly accelerated/decelerated, the step of determining a basic amount of fuel injection Qbase from an accelerator opening APS and an engine revolution speed RPM, the step of determining an amount of fuel injection (minimum torque fuel injection) Qbad needed at the time of drive power being first transmitted to drive wheels from an engine based on water temperature Tw and engine revolution speed RPM, the step of calculating a difference Qabs by subtracting the minimum torque fuel injection Qbad from the basic value Qbase, the step of determining a correction value Qacl2 to counterbalance the fluctuation of the engine revolution speed RPM based on the difference Qabs, engine revolution speed RPM, engine revolution speed change ΔRPM and/or its differential value DΔRPM, and the step of sequentially increasing/decreasing an amount of fuel injection in accordance with the correction value Qacl2, thereby attenuating the torsional vibration.

The difference Qabs between the basic value Qbase and minimum torque fuel injection Qbad is substantially a parameter of determining the magnitude of the torsional vibration occurring in the drive train. This is because the difference Qabs obtained by subtracting the minimum torque fuel injection Qbad at the time of the drive power being first transmitted to the vehicle from the basic fuel injection Qbase indicates how much more (or less) amount of fuel has injected relative to Qbad. In the present invention, therefore, by determining the correction value Qacl2 using this difference Qabs, the fuel is injected in a manner to offset the fluctuation of the engine revolution speed RPM, and consequently the torsional vibration in the drive train is promptly damped.

Since the minimum torque fuel injection Qbad needed to obtain the difference Qabs varies with the engine revolution speed RPM and water temperature Tw, the minimum torque fuel injection Qbad is determined from RPM and Tw, and the difference Qabs is calculated from the minimum torque fuel injection Qbad and the current fuel injection Qfnl (Qbase). If this difference Qabs is used to obtain the correction fuel injection Qacl, the torsional vibration in the drive train is efficiently attenuated even at a time of starting up of the engine at low temperature.

According to another aspect of the present invention, there is provided a method of attenuating torsional vibration in a drive train of a vehicle, including the step of detecting fluctuation in engine revolution speed that varies with torsional vibration in the drive train caused upon quick acceleration or deceleration of the vehicle, the step of determining a basic amount of fuel injection Qbase from an accelerator opening APS and an engine revolution speed RPM, the step of determining an amount of fuel injection (minimum torque fuel injection) Qbad needed at the time of drive power being first transmitted to drive wheels from the engine from water temperature Tw and engine revolution speed RPM, the step of obtaining a difference Qabs by subtracting the minimum torque fuel injection Qbad from the basic value Qbase, the step of determining a correction value Qacl from the difference Qabs and engine revolution speed RPM, the step of determining a second correction value Qacl2 from the first correction value Qacl, engine revolution speed change ΔRPM and/or its differential value D ΔRPM to counterbalance the engine revolution speed fluctuation, the step of adding the second correction value Qacl2 and the basic value Qbase to obtain a final amount of fuel injection Qfnl, and the step of sequentially increasing/decreasing an amount of fuel injection in accordance with the final value Qfnl.

According to a third aspect of the present invention, there is provided a method of attenuating torsional vibration in a drive train of a vehicle, including the step of detecting engine revolution speed fluctuation that varies with torsional vibration caused in the drive train when the vehicle is accelerated/decelerated, the step of determining a temporary correction value Qacl2 that counterbalances the fluctuation of engine revolution speed based on engine revolution speed change ΔRPM and its differential value DΔRPM, the step of determining a correction coefficient $Q_{MPX}$ based on difference Qdelta between a final amount of fuel injection Qaclini before acceleration/deceleration and current basic amount of fuel injection Qbase, the step of multiplying Qacl2 by $Q_{MPX}$ to obtain a final correction value $Qacl_{MPX}$, the step of sequentially increasing/decreasing a target amount of fuel injection Qfnl in accordance with $Qacl_{MPX}$, and the step of injecting fuel of the target amount Qfnl increased/decreased into the engine, thereby attenuating the torsional vibration.

The difference Qdelta between the before-acceleration/deceleration final value of fuel injection Qaclini and the current basic fuel injection Qbase is, as mentioned above, the cause of the fluctuation of the engine revolution speed RPM, i.e., the cause of torsional vibration in the drive train. Therefore, the correction coefficient $Q_{MPX}$ is determined from this difference Qdelta, and the temporary correction value Qacl2 is multiplied by this coefficient $Q_{MPX}$ to obtain the ultimate correction value $Qacl_{MPX}$. The resulting value $Qacl_{MPX}$ is an adjustment value prepared in consideration of not only the change ΔRPM of the engine revolution speed RPM and its differential value DΔRPM, but also the difference Qdelta that is the cause of the torsional vibration in the drive train. Therefore, by sequentially increasing/decreasing the target amount of fuel injection Qfnl in accordance with this adjustment value $Qacl_{MPX}$, the engine revolution speed fluctuation, i.e., the torsional vibration in the drive train can promptly be attenuated.

According to a fourth aspect of the present invention, there is provided a method of attenuating torsional vibration in a drive train of a vehicle by sequentially increasing/decreasing an amount of fuel to be injected into an engine, including the step of detecting engine revolution speed fluctuation that varies with torsional vibration caused in the drive train when the vehicle is accelerated/decelerated, the step of determining a basic amount of fuel injection Qbase from an accelerator opening APS and engine revolution speed RPM, the step of determining a temporary correction value Qacl2 from engine revolution speed change ΔRPM and/or its differential value DΔRPM to offset the fluctuation of engine revolution speed RPM, the step of determining a correction coefficient $Q_{MPX}$ based on difference Qdelta between a final amount of fuel injection Qaclini before acceleration/deceleration and current basic amount of fuel injection Qbase, the step of multiplying Qacl2 by $Q_{MPX}$ to obtain a final correction value $Qacl_{MPX}$, the step of adding $Qacl_{MPX}$ and Qbase to obtain a target amount of fuel injection Qfnl, and the step of injecting fuel of the target amount Qfnl into the engine.

The method may further include the step of determining whether the engine revolution speed fluctuation occurs upon shifting up/down of a transmission, and the step of adding the basic amount of fuel injection Qbase and correction value Qacl2 to obtain a target amount Qfnl of fuel injection, if it is determined that the engine revolution speed fluctuation occurs upon shifting up/down (transmission gear position change). If, on the other hand, it is determined that the engine revolution speed fluctuation does not take place upon shifting up/down, then the correction value $Qacl_{MPX}$ is added to the basic value Qbase to obtain the target value Qfnl.

The engine revolution speed fluctuation is not always caused by increase/decrease in the amount of fuel injection. For instance, it may be caused by shifting up or down. If such is the case, the increase/decrease of the fuel injection does not relate to the generation of the engine revolution speed fluctuation (generation of torsional vibration in the drive train) at all. Thus, if the target amount of fuel injection is adjusted in accordance with the increase/decrease of the fuel injection in such a case, the engine is forced to rotate unnecessarily. As a result, longer time is required until the torsional vibration completely attenuates. In the present invention, therefore, the target amount of fuel injection is not adjusted in accordance with the increase/decrease of the fuel injection if the engine revolution speed fluctuation is caused upon shifting up/down.

In other words, when the engine revolution speed fluctuation takes places due to the shift changing, the correction value Qacl2, which is determined based on the engine revolution speed change ΔRPM and/or its differential value DΔRPM without considering the increase/decrease of the fuel injected, is added to the basic value Qbase to obtain Qfnl. When the engine revolution speed fluctuation occurs while no shift up/down operation is being performed, Qfnl is obtained by adding Qbase and $Qacl_{MPX}$, which is determined in consideration of the increase/decrease of the fuel injection.

According to a fifth aspect of the present invention, there is provided an apparatus for attenuating torsional vibration in a drive train coupling an engine with drive wheels, including means for detecting engine revolution speed fluctuation that varies with torsional vibration caused in the drive train when the vehicle is accelerated/decelerated, means for determining a basic amount of fuel injection Qbase from an accelerator opening APS and an engine revolution speed RPM, means for determining an amount of fuel injection (minimum torque fuel injection) Qbad needed at the time of drive power being first transmitted to the drive wheels from the engine based on water temperature Tw and engine revolution speed RPM, means for calculating a difference Qabs by subtracting the minimum torque fuel injection Qbad from the basic value Qbase, means for determining a correction value Qacl2 to counterbalance the fluctuation of the engine revolution speed RPM based on the difference Qabs, engine revolution speed RPM, engine revolution speed change ΔRPM and/or its differential value DΔRPM, and means for sequentially increasing/decreasing an amount of fuel injection in accordance with the correction value Qacl2, thereby attenuating the torsional vibration.

Additional objects, benefits and advantages of the present invention will become apparent to those skilled in the art to which this invention relates from the subsequent description of the embodiments and the appended claims, taken in conjunction with the accompanying drawings.

DETAILED DESCRIPTION OF THE INVENTION

Now, embodiments of the present invention will be described in reference to the accompanying drawings.

First Embodiment

Figure 1:
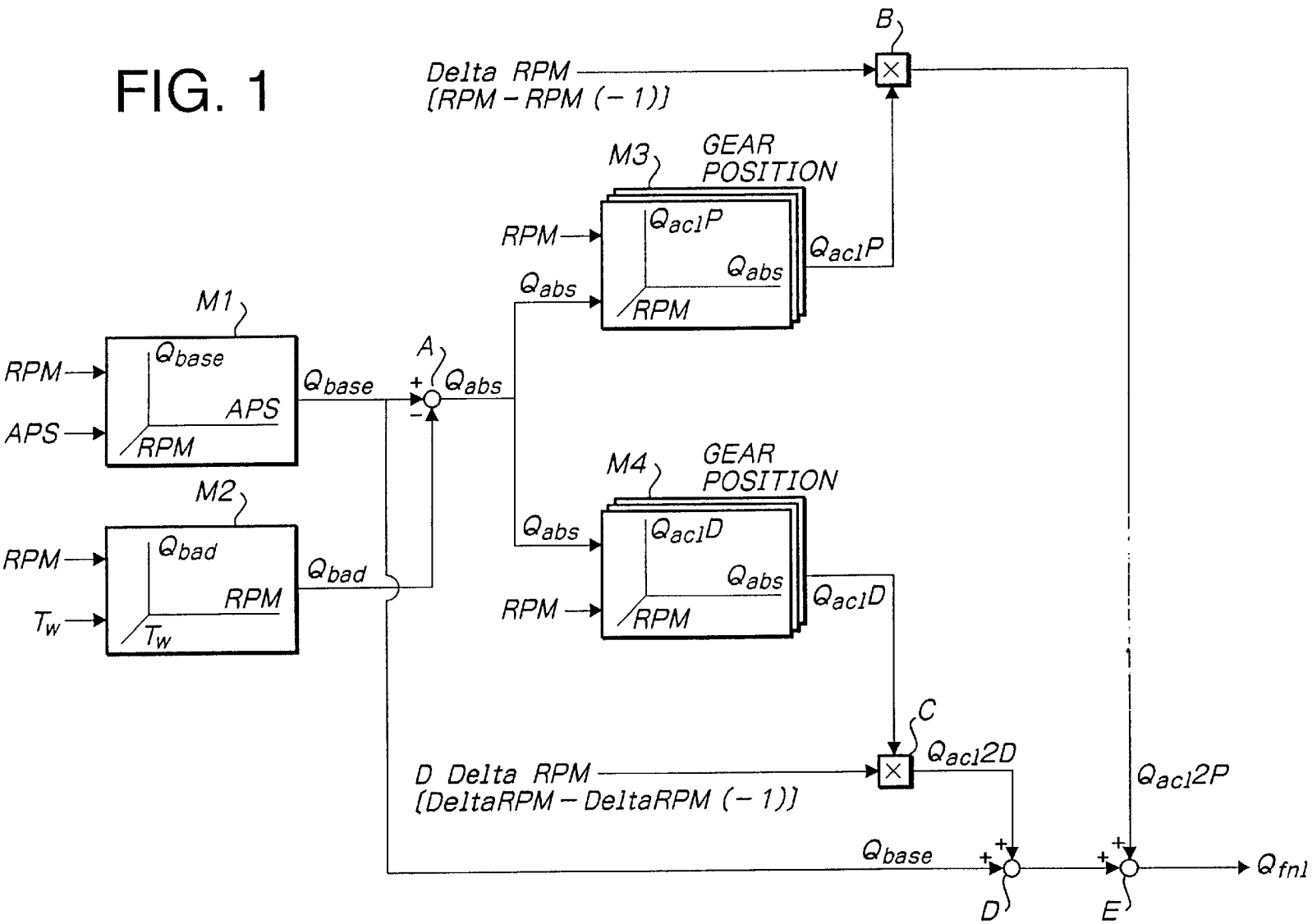
FIG. 1 illustrates a block diagram useful to explain a method of attenuating torsional vibration in a drive train according to one embodiment of the present invention.
Figure 2:
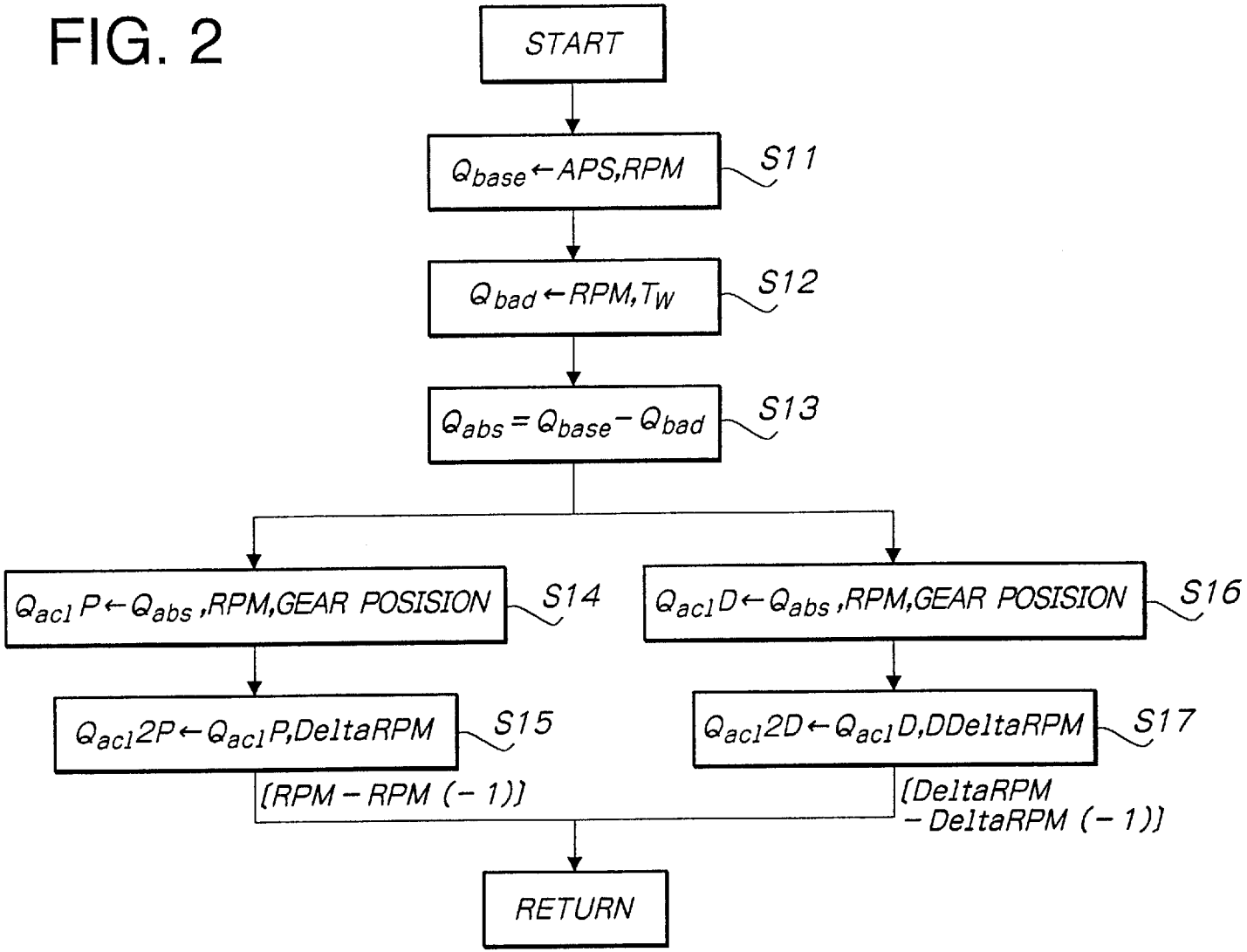
FIG. 2 illustrates a flowchart for determining a correction value Qacl2.

Referring to FIGS. 1 and 2, determination of a correction value Qacl2 will be described first.

As illustrated in FIG. 2, as step S11, a basic amount of fuel injection Qbase required at that point of time is determined from accelerator opening APS and engine revolution speed RPM. The basic amount of fuel Qbase is obtained from a map M1 shown in FIG. 1. As understood from FIG. 1, when the accelerator opening APS and engine revolution speed RPM are input, the map M1 outputs the basic amount of fuel Qbase. The accelerator opening APS is detected by an accelerator sensor (not shown) and engine revolution speed RPM is detected by an engine speed sensor (not shown).

At step S12, an amount of fuel Qbad needed at the time of minimum torque transmission is determined based on the engine revolution speed RPM and temperature Tw of water flowing in the engine. This value (referred to as "minimum torque fuel injection") Qbad indicates an amount of fuel injection needed when drive force is first transmitted to drive wheels from the engine when a vehicle is accelerated (see FIGS. 8A to 8E), and it varies with the water temperature Tw. The minimum torque fuel injection Qbad is obtained from a map M2 shown in FIG. 1.

Then map M2 outputs the minimum torque fuel injection Qbad depending upon the water temperature Tw. Specifically, when the water temperature is high, which means that the engine is sufficiently warmed up, the map M2 outputs low minimum torque fuel injection Qbad. On the other hand, when the water temperature is low, which means that the engine is not warmed up enough, the map M2 outputs a large value for Qbad. It should be noted that the water temperature Tw is detected by a water temperature sensor (not shown).

As step S13, the minimum torque fuel injection Qbad is subtracted from the basic amount of fuel injection Qbase to obtain the difference Qabs This difference Qabs is calculated by an adding unit A shown in FIG. 1. The difference Qabs is substantially a parameter of determining the size of torsional vibration in the drive train of the vehicle Specifically, the difference Qabs indicates how much of more (or less) fuel has been injected relative to an amount of fuel injected at the time of drive power being first transmitted to the drive wheels from the engine. Therefore, it can be said that the difference Qabs is a substantial parameter of determining the torsional vibration in the drive train (see FIGS. 8A to 8E). After step S13, the program proceeds to both steps S14 and S16.

At step S14, a correction coefficient Qaclp is determined from the difference Qabs, engine revolution speed RPM, and gear position of the transmission. The correction coefficient Qaclp is obtained from a map M3 shown in FIG. 1. Based on the difference Qabs, the map M3 provides the coefficient $Qacl_P$ utilized in offsetting the torsional vibration in the drive train. The map M3 is prepared for each of the transmission gears. The coefficient $Qacl_P$ is determined to conform with engine revolution speed change ΔRPM (will be described at step S15).

At step S15, the correction coefficient Qaclp is multiplied by the engine revolution speed change ΔRPM to obtain a correction value $Qacl2_P$ that offsets the engine revolution speed fluctuation caused by the torsional vibration in the drive train. The value ΔRPM is calculated by subtracting a previous engine revolution speed RPM(−1) from the current engine revolution speed RPM. The correction value $Qacl2_P$ is calculated by a multiplier B shown in FIG. 1. The correction value $Qacl2_P$ is a value determined in consideration of the engine revolution speed change ΔRPM and the difference Qabs.

At step S16, another correction coefficient $Qacl_D$ is determined from the difference Qabs, engine revolution speed RPM and gear position. This correction coefficient $Qacl_D$ is obtained from a map M4 shown in FIG. 1. When the difference Qabs is input, the map M4 outputs the correction coefficient $Qacl_D$ that is used in offsetting the torsional vibration in the drive train. The MAP 4 is prepared for each of gear positions of the transmission. Unlike the first correction value $Qacl_P$, this coefficient $Qacl_D$ is prepared to conform with a differential value DΔRPM of engine revolution speed change ΔRPM (will be described in connection with step S17).

At step S17, the second correction coefficient $Qacl_D$ is multiplied by the engine revolution speed change differential value DΔRPM to obtain another correction value $Qacl2_D$ to offset the engine revolution speed fluctuation caused by the torsional vibration in the drive train. This differential value DΔRPM is obtained by subtracting a previous engine revolution speed change ΔRPM(−1) from the current engine revolution speed change ΔRPM. This value represents the change of ΔRPM, i.e., acceleration of RPM. The correction value $Qacl2_D$ is calculated by a multiplier C shown in FIG. 1. This correction value $Qacl2_D$ is a value determined in consideration of the engine revolution speed change differential value DΔRPM and the difference Qabs.

In this manner, the correction values $Qacl2_P$ and $Qacl2_D$ are computed, and the program proceeds to "RETURN".

Next, determination of the final (target) amount of fuel injection Qfnl at the time of vehicle acceleration will be described in reference to FIGS. 1 and 3.

Figure 3:
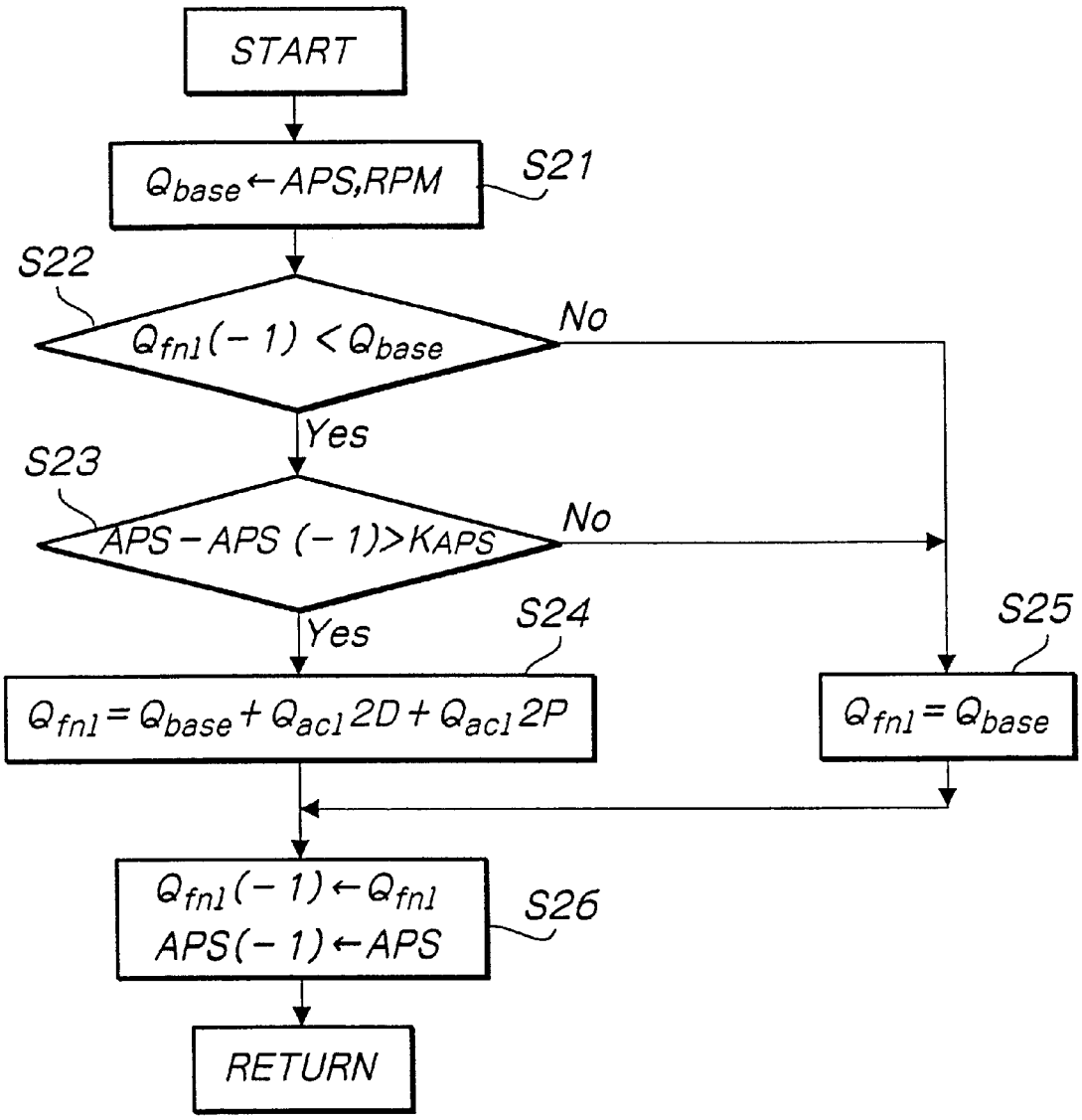
FIG. 3 illustrates a flowchart for determining a final amount of fuel injection Qfnl when a vehicle is accelerated.

As illustrated in FIG. 3, at step S21, the basic amount of fuel injection Qbase is determined from the accelerator opening APS and engine revolution speed RPM. This basic value Qbase is identical to the basic value Qbase obtained at step S11 in FIG. 2, and obtained from the map M1 shown in FIG. 1.

At step S22, it is determined whether the previous amount of fuel injection Qfnl(−1) is smaller than the current basic amount of fuel injection Qbase. If Qfin(−1)<Qbase is holds true, then it means that the vehicle is accelerating. Otherwise, it is determined that the vehicle is not accelerating. If the vehicle is accelerating, the program proceeds to step S23. If it is not, the program proceeds to step S25.

At step S23, it is determined whether the resultant obtained by subtracting the previous accelerator opening APS(−1) from the current accelerator opening APS is greater than a predetermined value $K_{APS}$. If the answer is Yes, it means that an accelerator pedal is stamped rapidly, i.e., the vehicle is in a rapid acceleration condition. If the answer is No, it means that the accelerator pedal is not stamped so deeply, i.e., the vehicle is not in the rapid acceleration condition. If it is the sudden acceleration, the program proceeds to step S24. If not, the program proceeds to step S25.

At step S24, the basic value Qbase obtained at step S21, the correction value $Qacl2_P$ obtained at step S15 and another correction value $Qad2_D$ obtained at step S17 are added to each other to determine the target amount of fuel injection Qfnl. This value is calculated by adders D and E shown in FIG. 1.

This final value Qfnl is a value determined in consideration of the first correction value $Qacl2_P$ acquired from the difference Qabs and engine revolution speed change ΔRPM, and the second correction value $Qacl2_D$ acquired from the difference Qabs and engine revolution speed change differential value DΔRPM while the basic value Qbase determined from the accelerator opening APS and engine revolution speed RPM is being used as a fundamental value (see FIGS. 8A to 8E).

On the other hand, if it is determined at step S22 that the vehicle is not accelerating or determined at step S23 that the vehicle is accelerating but the acceleration is not steep, then the program proceeds to step S25. At step S25, the basic amount of fuel injection Qbase is used as the final (target) amount of fuel injection Qfnl. In other words, no correction is made to the amount of fuel injection in order to offset the torsional vibration in the drive train. This is because in such a case large torsional vibration which makes passengers in the vehicle feel uncomfortable does not occur.

After that, at step S26, the current target amount of fuel injection Qfnl is named "previous" target amount of fuel injection Qfnl(−1) for the next routine of control. Specifically it is used at step S22 in the next routine. Likewise, the current accelerator opening APS is changed to "previous" opening APS(−1). This value is used at step S23 in the next routine of control. Then, the program proceeds to "RETURN."

According to the above described method of attenuating the torsional vibration in the drive train coupling the engine with the drive wheels, the target amount of fuel injection Qfnl is determined from the first correction value $Qacl2_P$ obtained from the difference Qabs and engine revolution speed change ΔRPM and the second correction value $Qacl2_D$ obtained from the difference Qabs and engine revolution speed change differential value DΔRPM, with the basic value Qbase determined from the accelerator opening degree APS and engine revolution speed RPM (see FIGS. 8A to 8E) being utilized as the fundamental value. Consequently, the torsional vibration that occurs in the drive train upon sudden acceleration is efficiently damped.

This is because the value Qabs is a difference between the basic value Qbase and minimum torque fuel injection Qbad, and therefore it is substantially a parameter that determines the magnitude of the torsional vibration in the drive train. Specifically, the resultant value obtained by subtracting the minimum torque fuel injection Qbad, which is needed when drive power is first transmitted to the drive wheels from the engine, from the basic amount of fuel injection Qbase indicates how much more (or less) fuel has been injected relative to the amount of fuel injected at the time of the drive power being first transmitted to the drive wheels. This can substantially be used as a parameter to determine the size of the torsional vibration in the drive train.

By determining the correction values $Qacl2_P$ and $Qacl2_D$ from the difference Qabs and engine revolution speed change ΔRPM as well as its differential value DΔRPM to offset the engine revolution speed fluctuation (see FIG. 1) as in this embodiment, the torsional vibration occurring in the drive train caused upon sudden acceleration can be efficiently and quickly attenuated as compared with a technique of determining a correction value from the engine revolution speed change ΔRPM and/or its differential value DΔRPM without using the difference Qabs.

The minimum torque fuel injection Qbad needed to calculate the difference Qabs varies with the engine revolution speed RPM and water temperature Tw. In this embodiment, therefore, the value Qbad is determined from RPM and Tw. After that, the difference Qabs is determined from Qbad and Qbase, and the correction values $Qacl2_P$ and $Qacl2_D$ are determined from Qabs. As a result, even at a start-up of the vehicle under low temperature, it is possible to obtain appropriate correction values $Qacl2_P$ and $Qacl2_D$ that substantially counterbalance the torsional vibration in the drive train.

It should be noted that the above description only deals with a case where the vehicle is accelerated. However, similar control can be applied when the vehicle is decelerated. Further, although both of the correction values $Qadl2_P$ and $Qacl2_D$ are used in the illustrated embodiment, only one of them may be employed.

Second Embodiment

Another embodiment of the present invention will now be described in reference to FIGS. 4 to 7 as well as FIGS. 8A to 8E. It should be noted that similar reference numerals and symbols are used to designate similar values and elements in the first and second embodiments.

First, determination of a correction value Qacl2 will be described using FIGS. 4 and 5.

Figure 4:
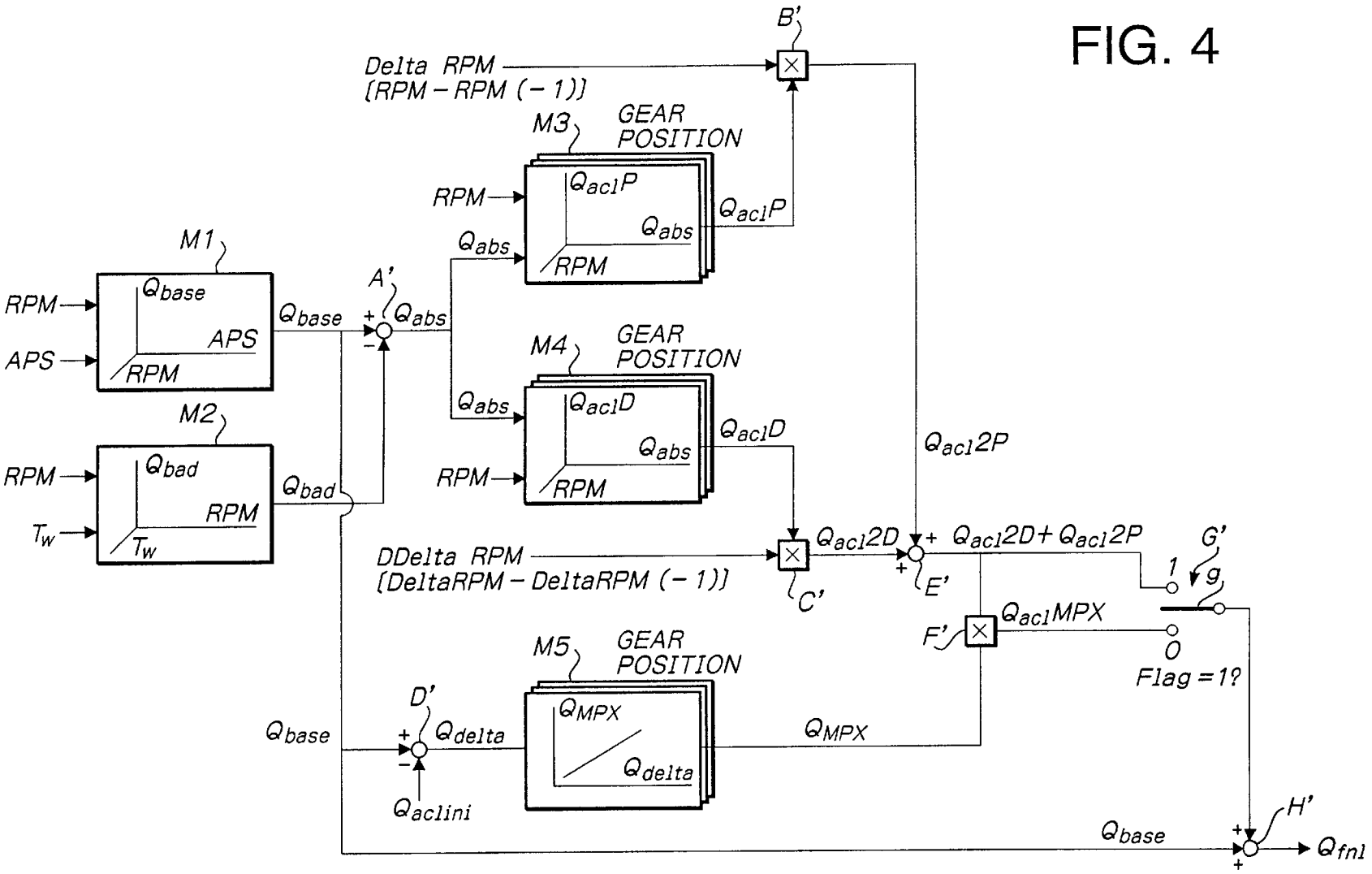
FIG. 4 illustrates a block diagram useful to explain a method of attenuating torsional vibration in a drive train according to another embodiment of the present invention.
Figure 5:
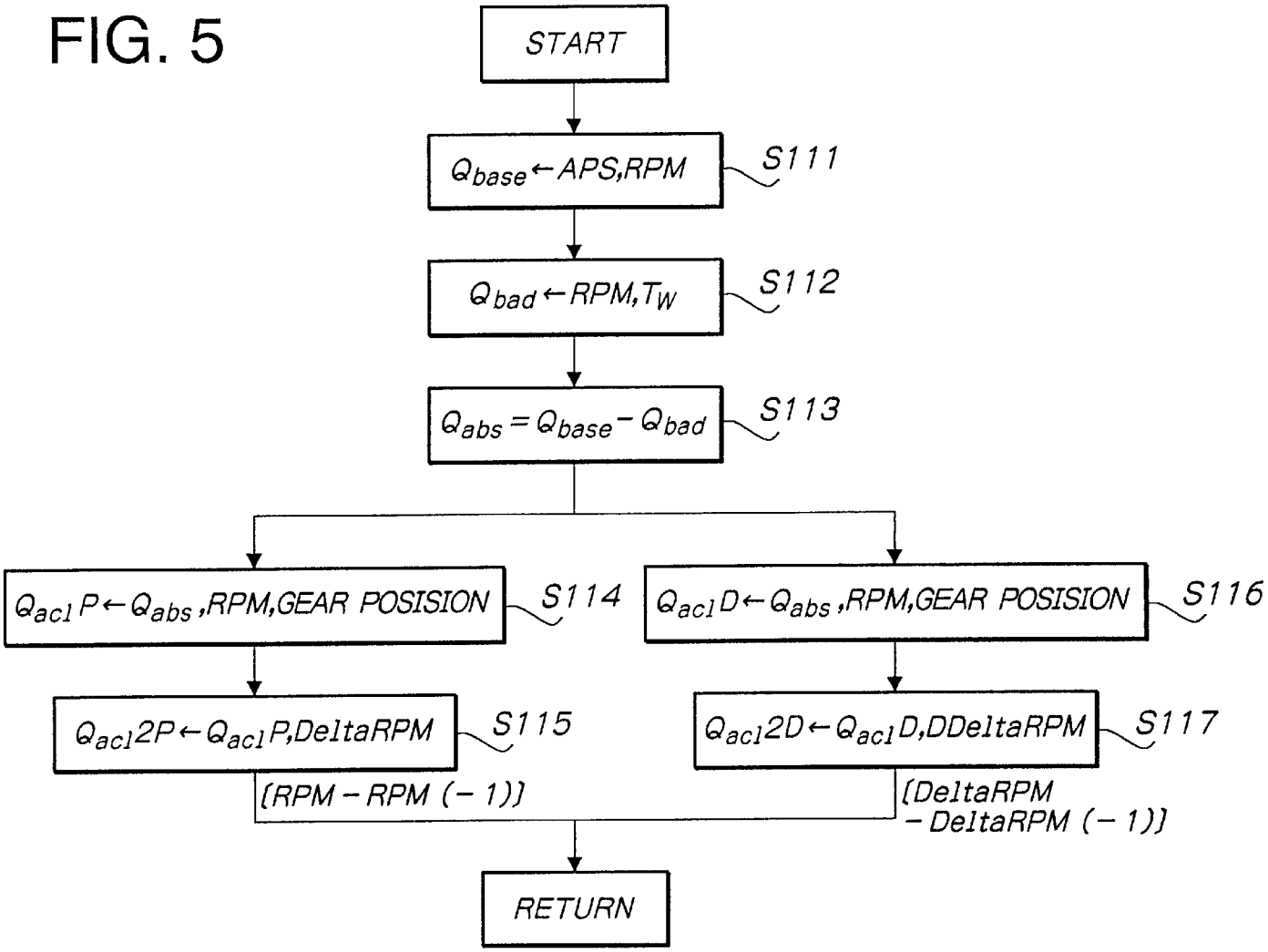
FIG. 5 illustrates a flowchart for determining a correction value Qacl2 in the second embodiment.

As illustrated in FIG. 5, at step S111, a basic amount of fuel injection Qbase required at that time is determined from accelerator opening degree APS and engine revolution speed RPM. The basic amount of fuel Qbase is obtained from a map M1 shown in FIG. 4. As understood from FIG. 4, when the accelerator opening APS and engine revolution speed RPM are input, the map M1 outputs the basic amount of fuel Qbase. The accelerator opening APS is detected by an accelerator sensor (not shown) and engine revolution speed RPM is detected by an engine speed sensor (not shown).

At step S112, an amount of fuel Qbad needed at the time of minimum torque transmission is determined based on the engine revolution speed RPM and temperature Tw of water flowing in the engine. This value (referred to as "minimum torque fuel injection") Qbad indicates an amount of fuel needed when drive force is first transmitted to drive wheels from the engine when a vehicle is accelerated (see FIGS. 8A to 8E), and it varies with the water temperature Tw. The minimum torque fuel injection Qbad is obtained from a map M2 shown in FIG. 4.

Then map M2 outputs the minimum torque fuel injection Qbad depending upon the water temperature Tw. Specifically, when the water temperature Tw is high, which means that the engine is sufficiently warmed up, the map M2 outputs a low value for the minimum torque fuel injection Qbad. On the other hand, when the water temperature is low, which means that the engine is not warmed up enough, the map M2 outputs a large value for Qbad. It should be noted that the water temperature Tw is detected by a water temperature sensor (not shown).

As step S113, the minimum torque fuel injection Qbad is subtracted from the basic amount of fuel injection Qbase to obtain the difference Qabs. This difference Qabs is calculated by an adding unit A' shown in FIG. 4. The difference Qabs is substantially a parameter of determining the size of torsional vibration in the drive train of the vehicle. Specifically, the difference Qabs indicates how much of more (or less) fuel has been injected relative to an amount of fuel injected at the time of drive power being first transmitted to the drive wheels from the engine. Therefore, it can be said that the difference Qabs is a substantial parameter of determining the torsional vibration in the drive train (see FIGS. 8A to 8E). After step S113, the program proceeds to both of steps S114 and S116.

At step S114, a correction coefficient $Qacl_P$ is determined from the difference Qabs, engine revolution speed RPM, and gear position of the transmission. The correction coefficient $Qacl_P$ is obtained from a map M3 shown in FIG. 4. Based on the difference Qabs, the map M3 provides the coefficient $Qacl_P$ utilized in offsetting the torsional vibration in the drive train. The map M3 is prepared for each of the transmission gear positions (shift positions). The coefficient $Qacl_P$ is determined to conform with engine revolution speed change ΔRPM (will be described at step S115).

At step S115, the correction coefficient $Qacl_P$ is multiplied by the engine revolution speed change ΔRPM to obtain a correction value $Qacl2_P$ that offsets the engine revolution speed fluctuation caused by the torsional vibration in the drive train. The value ΔRPM is calculated by subtracting a previous engine revolution speed RPM(−1) from the current engine revolution speed RPM. The correction value $Qacl2_P$ is calculated by a multiplier B' shown in FIG. 4. The correction value $Qacl2_P$ is a value determined in consideration of the engine revolution speed change ΔRPM and the difference Qabs.

At step S116, another correction coefficient $Qacl_D$ is determined from the difference Qabs, engine revolution speed RPM and gear position. This coefficient $Qacl_D$ is obtained from a map M4 shown in FIG. 4. When the difference Qabs is input, the map M4 outputs the coefficient $Qacl_D$ that is used in offsetting the torsional vibration in the drive train. The MAP 4 is prepared for each of gear positions of the transmission. Unlike the first coefficient $Qacl_P$, this coefficient $Qacl_D$ is prepared to conform with engine revolution speed change differential value DΔRPM (will be described in connection with step S117).

At step S117, the second correction coefficient $Qacl_D$ is multiplied by the differential value DΔRPM to obtain another correction value $Qacl2_D$ to offset the engine revolution speed fluctuation caused by the torsional vibration in the drive train. The engine revolution speed change differential value DΔRPM is obtained by subtracting a previous engine revolution speed change ΔRPM(−1) from the current engine revolution speed change ΔRPM. This value represents the change of ΔRPM, i.e., acceleration of RPM. The correction value $Qacl2_D$ is calculated by a multiplier C' shown in FIG. 4. This correction value $Qacl2_D$ is a value determined in consideration of the engine revolution speed change differential value DΔRPM and the difference Qabs.

In this manner, the correction values $Qacl2_P$ and $Qacl2_D$ are computed, and the program proceeds to "RETURN".

Next, determination of the final (target) amount of fuel injection Qfnl at the time of vehicle acceleration will be described in reference to FIGS. 4 and 6.

Figure 6:
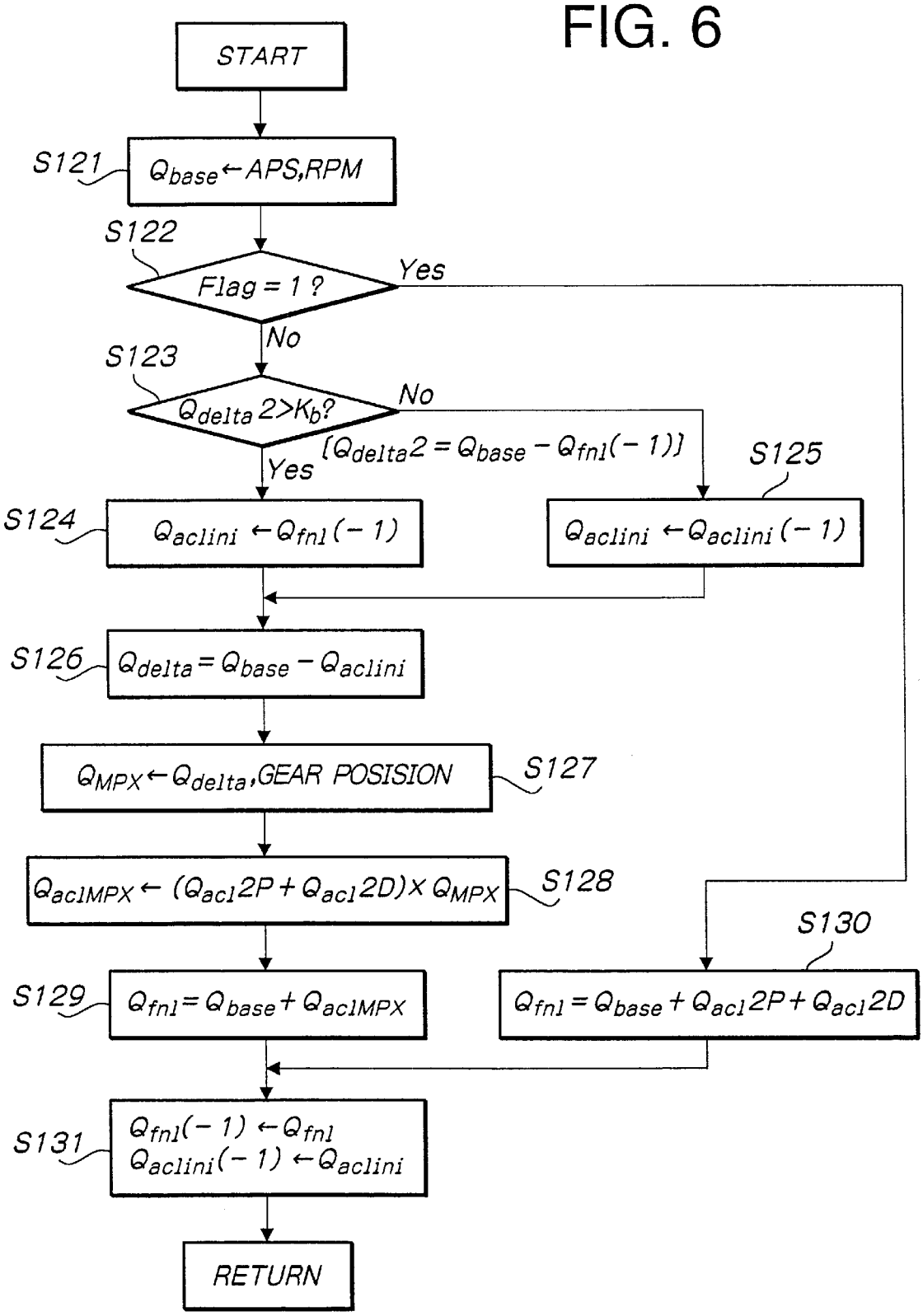
FIG. 6 illustrates a flowchart for determining a final amount of fuel injection Qfnl when a vehicle is accelerated in the second embodiment.

As illustrated in FIG. 6, at step S121, the basic amount of fuel injection Qbase is determined from the accelerator opening APS and engine revolution speed RPM. This basic value Qbase is identical to the basic value Qbase obtained at step S111 in FIG. 5, and obtained from the map M1 shown in FIG. 4.

At step S122, it is determined whether shifting up/down takes place in the transmission. If a driver makes a transmission gear position change, a flag is raised (Flag=1). Otherwise, the flag is not raised (Flag=0). Detection of the shifting up/down will be described later. If Flag=1 is established, the program proceeds to step S130. Otherwise, the program proceeds to step S123.

At step S123, it is determined whether difference Qdelta2 between the basic value Qbase (S121) and previous amount of fuel injection Qfnl(−1) is greater than a predetermined value Kb. This step determines whether a new (or additional) engine revolution speed change occurs due to the current fuel injection relative to the previous fuel injection. If the difference Qdelta2 is greater than Kb, the fuel injection of this time has caused the vehicle to accelerate and therefore the engine revolution speed RPM is caused to change. In such a case, the previous amount of fuel injection Qfnl(−1) is a target amount Qaclini of fuel injection before acceleration at this time (step S124).

On the other hand, if the difference Qdelta2 is smaller than or equal to the predetermined value Kb, there is no difference in the amount of fuel injection between the previous time and this time so that additional engine revolution speed change does not occur. Accordingly, the currently occurring engine revolution speed change is primarily caused by the change in the amount of fuel injected in the foregoing injection. Thus, in such a case, the previous final value Qaclini(−1) before acceleration is used as the final amount of fuel injection Qaclini before acceleration at this time (step S125).

At step S126, difference Qdelta is obtained by subtracting the final amount of fuel injection Qaclini before acceleration from the basic amount of fuel injection Qbase (S121). This difference Qdelta is calculated in an adder D' shown in FIG. 4. The value Qdelta is a difference between the amount of fuel injection before acceleration and the amount of fuel injection at this time, and is the cause the engine revolution speed change, i.e., torsional vibration in the drive train.

At step S127, a correction coefficient $Q_{MPX}$ is determined from the difference Qdelta and gear position. This coefficient $Q_{MPX}$ is obtained from a map M5 shown in FIG. 4. The map M5 is prepared for each of gear positions of the transmission. The map M5 outputs the coefficient $Q_{MPX}$ in accordance with the value of the difference Qdelta.

Specifically, when the difference Qdelta is large, it means that there is large difference between the amount of fuel injection before acceleration and the current amount of fuel injection. Thus, the engine revolution speed change (torsional vibration in the drive train) is greatly influenced by the change in the amount of fuel injection. In such a case, a large value is employed as the coefficient $Q_{MPX}$. On the other hand, if the difference Qdelta is small, it means that there is small difference between the amount of fuel injection before acceleration and the current amount of fuel injection so that the engine revolution speed change (torsional vibration in the drive train) is less influenced by the change in the amount of fuel injection. Thus, a small value is employed as the coefficient $Q_{MPX}$.

At step S128, the two correction values $Qacl2_P$ (step S115) and $Qacl2_D$ (step S117) are added and then multiplied by the correction coefficient $Q_{MPX}$ (step S127) to obtain a final correction value $Qacl_{MPX}$. Addition of the first and second correction values $Qacl2_P$ and $Qalc2_D$ is performed in an adder E' shown in FIG. 4, and multiplication of the resulting value by the coefficient $Q_{MPX}$ is performed in a multiplier F' shown in FIG. 4.

The final correction value $Qacl_{MPX}$ is obtained by adjusting the correction values $Qacl2_P$+$Qacl2_D$ with the coefficient $Q_{MPX}$, which is determined from the fuel injection difference Qdelta causing the engine revolution speed fluctuation (i.e., torsional vibration in the drive train), while the correction values $Qacl2_P$+$Qacl2_D$ determined to counterbalance the engine revolution speed fluctuation based on the engine revolution change ΔRPM and DΔRPM are used as the fundamental value.

At step S129, the basic value Qbase obtained at step S121 is added to the final correction value $Qacl_{MPX}$ obtained at step S 128 to determine the target amount of fuel injection Qfnl. This calculation is performed by a switching unit G' and adder H' shown in FIG. 4. Specifically, unless Flag=1 (i.e., when there is no shift position change; see step S122), a switch element "g" of the switch unit G' is turned to "0". In this case, the equation of Qfnl=$Qacl_{MPX}$+Qbase is established.

This target value Qfnl is an amount of fuel injection determined from the final correction value $Qacl_{MPX}$, which is derived from the temporary correction value ($Qacl2_P$+$Qacl2_D$) decided to offset the engine revolution speed fluctuation based on the engine revolution speed change ΔRPM, DΔRPM obtained at steps S115 and S117, while the basic value Qbase needed in accordance with the accelerator opening degree at that time obtained at step S121 is utilized as the fundamental value, and further in view of the difference Qdelta (parameter of the engine revolution speed fluctuation) obtained at step S128.

On the other hand, when Flag=1 at step S122 (i.e., when the transmission gear position is sifted up or down), the switch "g" of the unit G is turned to "1" (FIG. 4). Then, at step S130, the final amount of fuel injection Qfnl is determined by the final correction value of this case ($Qacl2_P$+$Qacl2_D$) plus the basic value Qbase.

This target amount of fuel injection Qfnl is a value determined from the sum of two correction values $Qacl2_P$+$Qacl2_D$ decided to offset the engine revolution speed fluctuation based on the engine revolution speed change ΔRPM, DΔRPM obtained at steps S115 and S117 while the basic value Qbase needed in accordance with the accelerator opening degree at that time obtained at step S121 is utilized as the fundamental value. Thus, when there is shifting up/down, the difference Qdelta (parameter of the engine revolution speed fluctuation) is neglected.

As described above, when the correction is made to the basic value abase to determine the target amount of fuel injection Qfnl, the sum of $Qacl2_P$+$Qacl2_D$ is utilized without any modification if there is shifting up or down (Flag=1), whereas the sum of $Qacl2_P$+$Qacl2_D$ is modified by multiplying the coefficient $Q_{MPX}$ (resulting value is $Qacl_{MPX}$) if there is no shift position change (Flag=0).

The latter correction value $Qacl_{MPX}$ which is determined in consideration of the difference Qdelta is different from the former correction value $Qacl2_P$+$Qacl2_D$ which is determined only from the engine revolution speed change ΔRPM, DΔRPM in that the latter correction value is able to attenuate the engine revolution speed fluctuation, i.e., torsional vibration in the drive train, more quickly since the engine revolution speed fluctuation caused by the difference Qdelta, which corresponds to the difference in amount of fuel injection, is additionally taken in account.

In sum, since the difference Qdelta between the amount of fuel injection Qaclini before acceleration and the basic value Qbase at this time (after acceleration) becomes the cause of the engine revolution speed fluctuation (torsional vibration in the drive train) as described earlier, the correction coefficient $Q_{MPX}$ is determined based on this difference Qdelta, and this coefficient $Q_{MPX}$ is multiplied by the correction value $Qacl2_P+Qacl2_D$ to determine the final correction value $Qacl_{MPX}$in the second embodiment. Such final correction value $Qacl_{MPX}$is a correction value determined in consideration of not only the engine revolution speed change ΔRPM, DΔRPM but the difference Qdelta causing the torsional vibration in the drive train.

Therefore, by sequentially amending (increasing or decreasing) the target amount of fuel injection Qfnl by adding the final correction value $Qacl_{MPX}$to the basic value Qbase, it is possible to quickly damp the engine revolution speed fluctuation, i.e., torsional vibration in the drive train.

The correction value $Qacl_{MPX}$ determined from the engine revolution change represented by the difference Qdelta is only employed when Flag is not "1" at step 122, i.e., when there is no shifting up/down. If, on the other hand, Flag=1, the program proceeds to step S130 without seeking for $Qacl_{MPX}$, and the correction values $Qacl2_P$ and $Qacl2_D$ obtained at steps S115 and S117 are employed as they are.

This is because the engine revolution speed fluctuation is not always caused by increase/decrease in the amount of fuel injection; for instance, it may be caused by shifting up/down. If the engine revolution speed fluctuation results from the shifting up or down, the increase and decrease in the amount of fuel injection (difference Qdelta) does not contribute to generation of the engine revolution speed fluctuation (torsional vibration in the drive train) at all. If the amount of fuel injection is corrected in view of the increase/decrease in the amount of fuel injection (Qdelta) even in such a case, the engine is forced to rotate unnecessarily and a longer time is required until the torsional vibration is damped.

Accordingly, only when Flag=0, i.e., there is no shifting up/down, the correction value $Qacl_{MPX}$ determined in consideration of the difference Qdelta is employed, whereas when Flag=1, i.e., there is shifting up/down, the difference Qdelta is not taken in account and the correction values $Qacl2_P+Qacl2_D$ obtained at steps S115 and S117 are directly employed without additional modification.

In other words, when there is no shifting up/down, the engine revolution speed fluctuation may be caused by the difference Qdelta (change in the amount of fuel injection), and therefore the difference Qdelta is considered in determining the correction value ($Qacl_{MPX}$). When there is shifting up/down, the engine revolution speed fluctuation is caused regardless of the difference Qdelta and therefore the target amount of fuel injection is corrected with the correction values $Qacl_P+Qacl2_D$ without considering the difference Qdelta. Therefore, in either case, it is feasible to promptly attenuate the torsional vibration occurring in the drive train.

At step S131, the current target amount of fuel injection Qfnl is renamed to the previous target value Qfnl(−1) for the next routine of control. This "previous" value Qfnl(−1) is used at steps S123 and S124 in the next control. Likewise, the amount of fuel injection before acceleration Qaclini is renamed to the previous value Qadini(−1) for use at step S125 in the next routine of control. Then, the program proceeds to "RETURN."

Figure 7:
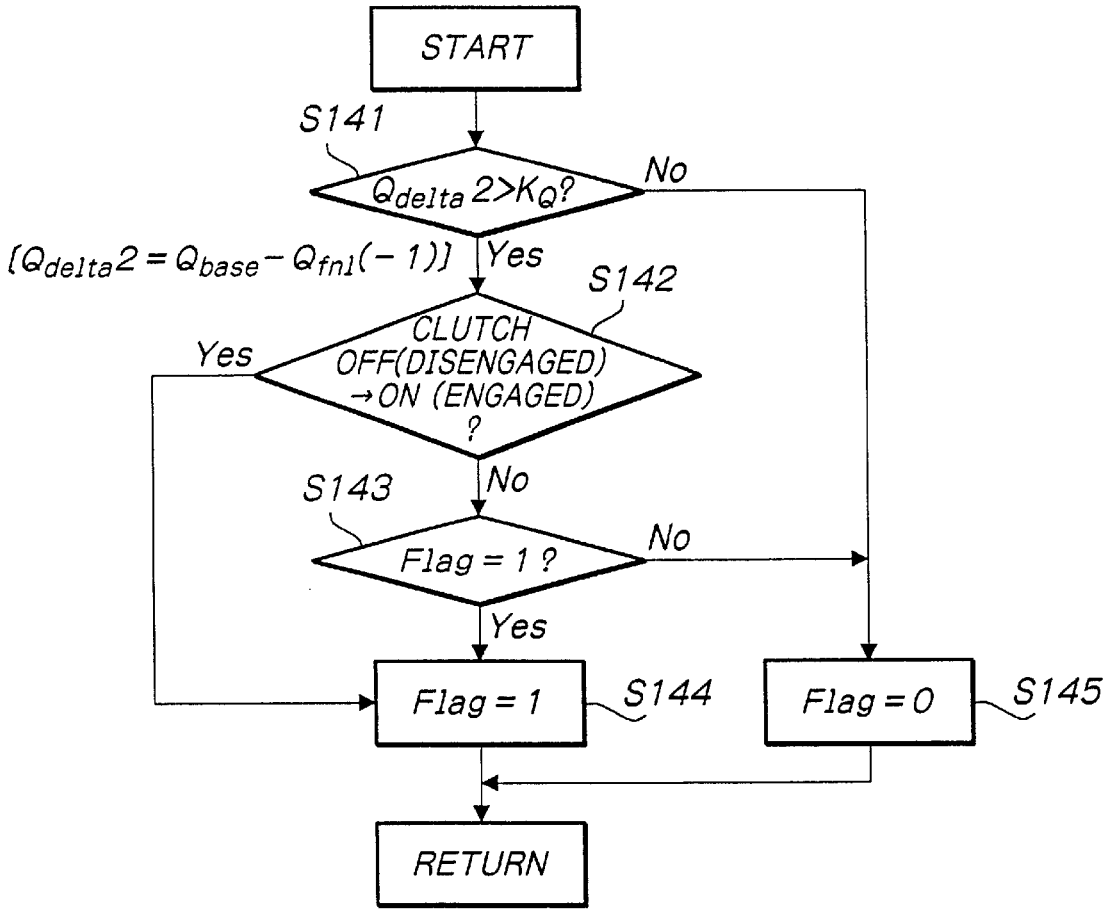
FIG. 7 illustrates a flowchart for determining whether shifting up/down takes place.
Figures 8A, 8B, 8C, 8D, 8E:
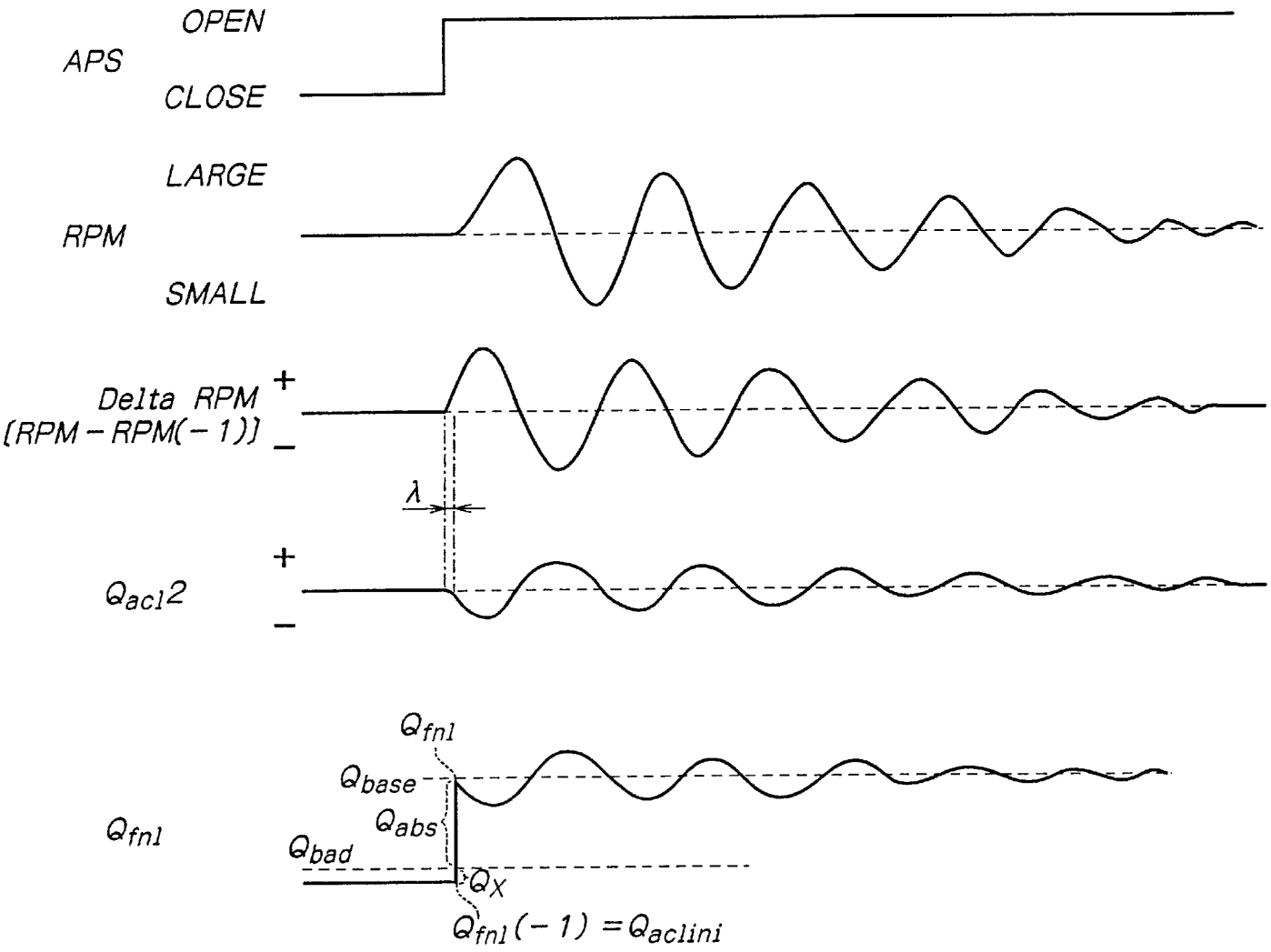
FIG. 8A illustrates a timing chart of an accelerator opening APS when the vehicle is accelerated.
FIG. 8B illustrates a timing chart of an engine revolution speed RPM.
FIG. 8C illustrates fluctuation of engine revolution speed change ΔRPM.
FIG. 8D illustrates a wave of correction value Qacl2.
FIG. 8E illustrates a target amount of fuel injection Qfnl.

Determination of occurrence of shift position change (shifting up or down), i.e., whether Flag=1 or 0, will be described in reference to FIG. 7.

At step S141, it is determined whether the difference Qdelta2 (difference between the basic value Qbase and the previous target amount of fuel injection Qfnl(−1)) is smaller than a prescribed value KQ. If the answer is YES, it means that a driver stamps the accelerator pedal little. It implies that the shifting up/down is taking place. Thus, the program proceeds to step S142. On the other hand, if $Qdelta2 \geqq K_Q$, then it is assumed that the accelerator pedal is stamped considerably and there is no shifting up/down. Thus, the program proceeds to step S145, thereby making Flag=0.

At step S142, it is determined whether the clutch is engaged from a disengaged condition. If the clutch is engaged from the disengaged condition while the accelerator pedal is hardly being stamped, it is assumed that the driver makes a shift position change. Then, the program proceeds to step S144, thereby making Flag=1. Otherwise, the program proceeds to step S143.

At step S143, it is determined whether Flag=1 is already established in the previous routine of control. If so, the program proceeds to step S144 and makes Flag=1. If not, the program advances to step S145 and makes Flag=0.

It should be noted that a shift position sensor may be provided near a root of a shift lever (not shown) for detecting occurrence of shifting up/down.

It should also be noted that the above description only deals with the case where the vehicle is accelerated, but similar control is executed when the vehicle is decelerated. In addition, one of the correction values $Qacl2_P$ and $Qacl2_D$ may be used in the correction procedure.

The illustrated and described method and arrangement are disclosed in Japanese Patent Application Nos. 11-152502 and 11-154023 filed on May 31, 1999 and Jun. 1, 1999 respectively, the instant application claims priority of these Japanese Patent Applications, and the entire disclosures thereof are incorporated herein by reference.

What is claimed is:

1. A method of attenuating torsional vibration in a drive train coupling an engine with drive wheels caused when a vehicle is accelerated or decelerated, comprising the steps of:

A) detecting fluctuation of engine revolution speed caused by torsional vibration occurring in a drive train of a vehicle upon acceleration or deceleration of the vehicle;

B) determining a basic amount of fuel injection (Qbase) from an accelerator opening (APS) and engine revolution speed (RPM);

C) determining an amount of fuel injection (Qbad) needed when drive power is first transmitted to drive wheels from an engine, from temperature of water (Tw) flowing in the engine and engine revolution speed (RPM);

D) subtracting the amount of fuel injection (Qbad) from the basic amount of fuel injection (Qbase) to obtain a difference (Qabs);

E) determining a correction value (Qacl2) from the difference (Qabs), engine revolution speed (RPM), change in the engine revolution speed (ΔRPM) and its differential value (DΔRPM) to counterbalance the fluctuation of engine revolution speed; and F) sequentially increasing or decreasing an amount of fuel injection (Qfnl) in accordance with the correction value (Qacl2).

2. The method of claim 1, wherein all the steps A to F are not performed when the acceleration/deceleration is not steep.

3. A method of attenuating torsional vibration in a drive train coupling an engine with drive wheels caused when a vehicle is accelerated or decelerated, comprising the steps of:

A) detecting fluctuation of engine revolution speed caused by torsional vibration occurring in a drive train of a vehicle upon acceleration or deceleration of the vehicle;

B) determining a basic amount of fuel injection (Qbase) from an accelerator opening (APS) and engine revolution speed (RPM);

C) determine an amount of fuel injection (Qbad) needed when drive power is first transmitted to drive wheels from an engine, from temperature of water (Tw) flowing in the engine and engine revolution speed (RPM);

D) subtracting the amount of fuel injection (Qbad) from the basic amount of fuel injection (Qbase) to obtain a difference (Qabs);

E) determining a first correction value (Qacl) from the difference (Qabs) and engine revolution speed (RPM);

F) determining a second correction value (Qacl2) from the first correction value (Qacl), change in engine revolution speed (ΔRPM) and its differential value (DΔRPM) to counterbalance the fluctuation of engine revolution speed;

G) adding the second correction value (Qacl2) to the basic amount of fuel injection (Qbase) to determine a target amount of fuel injection (Qfnl); and H) injecting fuel into the engine in accordance with the target amount of fuel injection (Qfnl).

4. The method of claim 3, wherein all the steps A to H are not performed when the acceleration/deceleration is not steep.

5. A method of attenuating torsional vibration in a drive train coupling an engine with drive wheels caused when a vehicle is accelerated or decelerated, comprising the steps of:

A) detecting fluctuation of engine revolution speed caused by torsional vibration occurring in a drive train of a vehicle upon acceleration or deceleration of the vehicle;

B) determining a first correction value (Qacl2) from change in engine revolution speed (ΔRPM) and its differential value (DΔRPM) to counterbalance the fluctuation of engine revolution speed;

C) determining a correction coefficient ($Q_{MPX}$) from a difference (Qdelta) between an amount of fuel injection of before acceleration or deceleration (Qaclini) and a basic amount of fuel injection (Qbase) after acceleration or deceleration;

D) multiplying the correction coefficient ($Q_{MPX}$) by the first correction value (Qacl2) to obtain a second correction value ($Qacl_{MPX}$); and E) sequentially increasing or decreasing an amount of fuel injection (Qfnl) in accordance with the second correction value ($Qacl_{MPX}$).

6. The method of claim 5, wherein all the steps A to E are not performed when the acceleration/deceleration is not steep.

7. A method of attenuating torsional vibration in a drive train coupling an engine with drive wheels caused when a vehicle is accelerated or decelerated, comprising the steps of:

A) detecting fluctuation of engine revolution speed caused by torsional vibration occurring in a drive train of a vehicle upon acceleration or deceleration of the vehicle;

B) determining a basic amount of fuel injection (Qbase) from accelerator opening (APS) and engine revolution speed (RPM);

C) determining a first correction value (Qacl2) from change in engine revolution speed (ΔRPM) and its differential value (DΔRPM) to counterbalance the fluctuation of engine revolution speed;

D) determining a correction coefficient ($Q_{MPX}$) from a difference (Qdelta) between an amount of fuel injection of before acceleration or deceleration (Qaclini) and a basic amount of fuel injection (Qbase) after acceleration or deceleration;

E) multiplying the correction coefficient ($Q_{MPX}$) by the first correction value (Qacl2) to obtain a second correction value ($Qacl_{MPX}$);

F) adding the second correction value ($Qacl_{MPX}$) to the basic amount of fuel injection (Qbase) to determine a target amount of fuel injection (Qfnl); and G) sequentially increasing or decreasing an amount of fuel injection in accordance with the target amount of fuel injection (Qfnl).

8. The method of claim 7 further including the steps of:

H) determining whether the fluctuation of engine revolution speed occurs upon shifting up or down before step D; and I) determining the target amount of fuel injection (Qfnl) by adding the basic amount of fuel injection (Qbase) to the first correction value (Qacl2) and skipping steps D, E and F when the fluctuation of engine revolution speed occurs upon shifting up or down.

9. The method of claim 7, wherein all the steps A to G are not performed when the acceleration/deceleration is not steep.

10. An apparatus for attenuating torsional vibration in a drive train coupling an engine with drive wheels caused when a vehicle is accelerated or decelerated, comprising:

means for detecting fluctuation of engine revolution speed caused by torsional vibration occurring in a drive train of a vehicle upon acceleration or deceleration of the vehicle;

means for determining a basic amount of fuel injection (Qbase) from an accelerator opening (APS) and engine revolution speed (RPM);

means for determining an amount of fuel injection (Qbad) needed when drive power is first transmitted to drive wheels from an engine, from temperature of water (Tw) flowing in the engine and engine revolution speed (RPM);

means for subtracting the amount of fuel injection (Qbad) from the basic amount of fuel injection (Qbase) to obtain a difference (Qabs);

means for determining a correction value (Qacl2) from the difference (Qabs), engine revolution speed (RPM), change in the engine revolution speed (ΔRPM) and its differential value (DΔRPM) to counterbalance the fluctuation of engine revolution speed; and means for sequentially increasing or decreasing an amount of fuel injection in accordance with the correction value (Qacl2).

11. An apparatus for attenuating torsional vibration in a drive train coupling an engine with drive wheels caused when a vehicle is accelerated or decelerated, comprising:

means for detecting fluctuation of engine revolution speed caused by torsional vibration occurring in a drive train of a vehicle upon acceleration or deceleration of the vehicle;

means for determining a basic amount of fuel injection (Qbase) from an accelerator opening (APS) and engine revolution speed (RPM);

means for determining an amount of fuel injection (Qbad) needed when drive power is first transmitted to drive wheels from an engine, from temperature of water (Tw) flowing in the engine and engine revolution speed (RPM);

means for subtracting the amount of fuel injection (Qbad) from the basic amount of fuel injection (Qbase) to obtain a difference (Qabs);

means for determining a first correction value (Qacl) from the difference (Qabs) and engine revolution speed (RPM);

means for determining a second correction value (Qacl2) from the first correction value (Qacl), change in engine revolution speed (ΔRPM) and its differential value (DΔRPM) to counterbalance the fluctuation of engine revolution speed;

means for adding the second correction value (Qacl2) to the basic amount of fuel injection (Qbase) to determine a target amount of fuel injection (Qfnl); and means for injecting fuel into the engine in accordance with the target amount of fuel injection (Qfnl).

12. An apparatus for attenuating torsional vibration in a drive train coupling an engine with drive wheels caused when a vehicle is accelerated or decelerated, comprising:

means for detecting fluctuation of engine revolution speed caused by torsional vibration occurring in a drive train of a vehicle upon acceleration or deceleration of the vehicle;

means for determining a first correction value (Qacl2) from change in engine revolution speed (ΔRPM) and its differential value (DΔRPM) to counterbalance the fluctuation of engine revolution speed;

means for determining a correction coefficient ($Q_{MPX}$) from a difference (Qdelta) between an amount of fuel injection of before acceleration or deceleration (Qaclini) and a basic amount of fuel injection (Qbase) after acceleration or deceleration;

means for multiplying the correction coefficient ($Q_{MPX}$) by the first correction value (Qacl2) to obtain a second correction value ($Qacl_{MPX}$); and means for sequentially increasing or decreasing an amount of fuel injection (Qfnl) in accordance with the second correction value ($Qacl_{MPX}$).

13. An apparatus for attenuating torsional vibration in a drive train coupling an engine with drive wheels caused when a vehicle is accelerated or decelerated, comprising:

means for detecting fluctuation of engine revolution speed caused by torsional vibration occurring in a drive train of a vehicle upon acceleration or deceleration of the vehicle;

means for determining a basic amount of fuel injection (Qbase) from accelerator opening (APS) and engine revolution speed (RPM);

means for determining a first correction value (Qacl2) from change in engine revolution speed (ΔRPM) and its differential value (DΔRPM) to counterbalance the fluctuation of engine revolution speed;

means for determining a correction coefficient ($Q_{MPX}$) from a difference (Qdelta) between an amount of fuel injection of before acceleration or deceleration (Qaclini) and a basic amount of fuel injection (Qbase) after acceleration or deceleration;

means for multiplying the correction coefficient ($Q_{MPX}$) by the first correction value (Qacl2) to obtain a second correction value ($Qacl_{MPX}$);

means for adding the second correction value ($Qacl_{MPX}$) to the basic amount of fuel injection (Qbase) to determine a target amount of fuel injection (Qfnl); and means for sequentially increasing or decreasing an amount of fuel injection in accordance with the target amount of fuel injection (Qfnl).

14. The apparatus of claim 13 further including:

means for determining whether the fluctuation of engine revolution speed occurs upon shifting up or down; and means for determining the target amount of fuel injection (Qfnl) by adding the basic amount of fuel injection (Qbase) to the first correction value (Qacl2) when the fluctuation of engine revolution speed occurs upon shifting up or down.

* * * * *